US009022072B2

(12) United States Patent
Pippes

(10) Patent No.: US 9,022,072 B2
(45) Date of Patent: May 5, 2015

(54) VALVE ARRAY

(75) Inventor: Thomas Pippes, Bad Ems (DE)

(73) Assignee: Carl Freudenberg KG, Weinheim (DE)

( * ) Notice: Subject to any disclaimer, the term of this patent is extended or adjusted under 35 U.S.C. 154(b) by 422 days.

(21) Appl. No.: 13/593,605

(22) Filed: Aug. 24, 2012

(65) Prior Publication Data

US 2013/0056103 A1 Mar. 7, 2013

(30) Foreign Application Priority Data

Sep. 1, 2011 (EP) ..... 11007100

(51) Int. Cl.
*F15B 13/02* (2006.01)
*F15B 1/027* (2006.01)

(52) U.S. Cl.
CPC ..... *F15B 1/027* (2013.01); *F15B 2211/212* (2013.01); *F15B 2211/255* (2013.01); *F15B 2211/40515* (2013.01); *F15B 2201/205* (2013.01); *F15B 2201/31* (2013.01); *F15B 2201/411* (2013.01); *F15B 2211/30505* (2013.01)

(58) Field of Classification Search
USPC ..... 137/485, 601.2; 251/30.01; 138/30, 38, 138/138
See application file for complete search history.

(56) References Cited

U.S. PATENT DOCUMENTS

| | | | | |
|---|---|---|---|---|
| 2,900,960 | A | 8/1959 | Gratzmuller | |
| 3,665,951 | A * | 5/1972 | Skinner | 137/115.07 |
| 3,782,418 | A * | 1/1974 | Zahid | 138/26 |
| 4,041,990 | A * | 8/1977 | Tang et al. | 138/31 |
| 4,555,976 | A * | 12/1985 | Wolfges | 91/420 |
| 5,086,863 | A * | 2/1992 | Tischer | 180/415 |
| 2006/0124428 | A1 * | 6/2006 | Baxter, Jr. | 192/85 CA |
| 2008/0314462 | A1 * | 12/2008 | Nakamura et al. | 137/614.02 |

FOREIGN PATENT DOCUMENTS

| | | | |
|---|---|---|---|
| DE | 4112065 | A * | 10/1992 |
| DE | 102009050847 | A1 | 4/2011 |
| WO | 2007035997 | A1 | 4/2007 |

* cited by examiner

*Primary Examiner* — Craig Schneider
*Assistant Examiner* — Angelisa Hicks
(74) *Attorney, Agent, or Firm* — Leydig, Voit & Mayer, Ltd.

(57) ABSTRACT

A valve array includes a reservoir containing a pressurized fluid, a non-return valve and a seat valve that is actuatable so as to allow the fluid to flow out of the reservoir. The seat valve is configured as a pilot control valve connected to the reservoir such that, in an open condition of the seat valve, a smaller amount of the fluid flows out of the reservoir via the seat valve and a larger amount of the fluid flows out of the reservoir via the non-return valve.

15 Claims, 3 Drawing Sheets

VALVE ARRAY

CROSS-REFERENCE TO PRIOR APPLICATION

Priority is claimed to European Patent Application No. EP 11 007 100.8, filed on Sep. 1, 2011, the entire disclosure of which is hereby incorporated by reference herein.

FIELD

The invention relates to a valve array comprising a reservoir containing a pressurized fluid, a seat valve and a non-return valve, whereby the seat valve can be actuated in such a way that an amount of fluid flows out of the reservoir.

BACKGROUND

Motor vehicles with automatic transmissions are already known from the state of the art. It is more and more often the case that these automobiles are available with a start-stop function.

Before this backdrop, conventional automatic transmissions that have a mechanically driven oil pump are equipped with a start-stop function.

In order to allow a faster and more comfortable start-up, the shilling elements needed for the start-up have to be supplied with hydraulic oil during the starting phase of the engine.

For this purpose, it is especially possible to employ a hydraulic reservoir that is filled via the main transmission pump and that releases its volume of stored oil whenever needed.

German laid-open document DE 10 2009 050 847 A1 discloses a device with which an amount of fluid that can be stored in a reservoir is released in a pulsed manner.

This device makes use of a valve array consisting of an electromagnetic seat valve and a non-return valve. This valve array is aimed at providing leak-proof regulation of a piston position as well as achieving a pulsed release of an amount of fluid stored in a reservoir.

A drawback here is the fact that a directly regulated seat valve is employed.

As soon as high volume flows are needed, the seat valve has to have appropriately large flow cross sections. This gives rise to high shifting forces and to a large and expensive magnet system.

High volume flows occur, particularly when the valve array is used in an automatic transmission for purposes of implementing a start-stop function.

Consequently, the prior-art valve array is not very suitable for use in an automatic transmission for purposes of implementing a start-stop function since it would require a great deal of installation space and entail high costs.

SUMMARY

In an embodiment, the present invention provides a valve array including a reservoir containing a pressurized fluid, a non-return valve and a seat valve that is actuatable so as to allow the fluid to flow out of the reservoir. The seat valve is configured as a pilot control valve connected to the reservoir such that, in an open condition of the seat valve, a smaller amount of the fluid flows out of the reservoir via the seat valve and a larger amount of the fluid flows out of the reservoir via the non-return valve.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
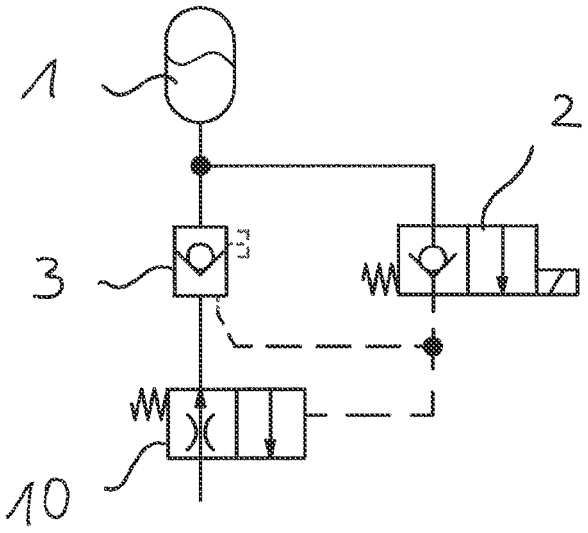
FIG. 1 is a schematic circuit diagram of the valve array according to an embodiment of the present invention, FIG. 2 a sectional drawing of a first embodiment of the valve array, whereby at least the non-return valve is integrated into a beaded baseplate of a piston reservoir, and FIG. 3 a sectional drawing of a second embodiment of the valve array, whereby at least the non-return valve is integrated into a baseplate of a piston reservoir that is screwed to the housing of the piston reservoir.

In an embodiment, the invention provides a valve array that has a compact and inexpensive design and that can be used in an automatic transmission for purposes of implementing a start-stop function.

A valve array according to an embodiment of the invention comprises a reservoir containing a pressurized fluid, a seat valve and a non-return valve, whereby the seat valve can be actuated in such a way that an amount of fluid flows out of the reservoir.

It is provided according to an embodiment of the invention that the seat valve is configured as a pilot control valve and it is connected to the reservoir in such a way that, when the seat valve is open, a smaller amount of fluid flows via the seat valve, causing a larger amount of fluid to flow out of the reservoir via the non-return valve.

It has been recognized according to an embodiment of the invention that such a valve array makes it possible to use a very small and thus inexpensive electromagnetic seat valve, preferably a microvalve, as the pilot control valve, since only a small regulating volume flow, namely, the smaller amount of fluid, flows via the seat valve. It has also been recognized that the required regulating volume flow can be removed from the reservoir itself. This allows the seat valve to have its own supply. Advantageously, it is possible to dispense with an additional source of pressure. Hence, a valve array is being put forward that has a compact and inexpensive design and that can be used in an automatic transmission for purposes of implementing a start-stop function.

The larger amount of fluid could be at least one and half times as much as the smaller amount of fluid. This allows the use of a very compact seat valve with small dimensions.

The reservoir could be connected to the seat valve as well as to the non-return valve so as to convey fluid. Owing to this concrete configuration, a smaller amount of fluid can be conveyed through a bypass line to the seat valve, while a larger amount of fluid can be fed through the non-return valve to a consumer.

A first line could lead from the reservoir to the seat valve, and a second line could lead to the non-return valve, whereby the smaller amount of fluid conveyed through the first line exerts pressure on a control piston that opens the non-return valve so that a larger amount of fluid can flow out through the non-return valve. A suitably dimensioned control piston can exert pressure on another suitably dimensioned component reliably and without being prone to malfunction.

Before this backdrop, the control piston could lie against a main piston that has a smaller cross-sectional surface area exposed to pressure. In this concrete configuration, as soon as the control piston is exposed to pressure, it acts on the main piston with such a force that the latter moves. This force can be precisely set on the basis of the surface area ratios of the surfaces exposed to pressure.

The main piston could hold a needle that lies against a spring-loaded ball of the non-return valve. The ball can be moved by means of the needle against the force of a spring. The movement of the ball causes the non-return valve to open, so that the larger amount of fluid can flow out to a consumer.

Before this backdrop, the non-return valve could be connected to or interact with a throttle which offers resistance to the fluid in the direction of flow of a fluid and which does not over resistance to the fluid in the opposite direction of flow. Thus, the throttle can have a flow-damping effect in one direction of flow. The non-return valve could be arranged between a throttle and the reservoir.

The seat valve could switch the throttle from one direction of flow into the other direction of flow. As a result, the setting of the seat valve can determine whether an amount of fluid is discharged from the reservoir quickly and without encountering great resistance or whether the reservoir is filled with a defined volume flow by an external pump.

The throttle could autonomously increase or decrease the resistance to the fluid as a function of the direction of flow of the fluid. This makes it possible to dispense with a connection leading to the seat valve.

Before this backdrop, it could be possible to fill the reservoir with fluid via the throttle. The fluid, preferably a hydraulic oil, can be filled into the reservoir by an external pump. This makes it possible to build up pressure inside the reservoir.

The valve array could have individual parts that are integrated into the reservoir. This translates into a compact valve array.

The reservoir could be configured as a piston reservoir having a baseplate into which the parts are integrated. After the baseplate has been pre-assembled, it can be easily joined with a positive fit to the piston reservoir by means of a bead. Before this backdrop, it is also conceivable for the baseplate with the integrated valve array to be secured to the cylindrical housing of the piston reservoir, which is open on one side. An advantage of this solution is the high level of modularity vis-à-vis the existing piston reservoir product line.

The parts can be arranged at an angle of 90° relative to the longitudinal axis of the reservoir. This arrangement saves a great deal of space.

The reservoir could have a baseplate that is positively joined to it. A positive fit can be created inexpensively.

The seat valve could be actuated electromagnetically. Consequently, it can be actuated by means of an electric control device.

The seat valve configured as a pilot control valve could be in the form of a 2/2-way seat valve or a 3/2-way seat valve. A 2/2-way seat valve is inexpensive. A 3/2-way seat valve saves on fluid connections, especially on spiral grooves in a control piston.

In principle, other types of valve can also be employed as the pilot control valve. In one embodiment, a slide valve can also be employed instead of a seat valve.

FIG. 1 shows a schematic circuit diagram of a valve array, comprising a reservoir 1 containing a pressurized fluid, preferably a hydraulic oil, a seat valve 2 and a non-return valve 3, whereby the seat valve 2 can be actuated in such a way that an amount of fluid flows out of the reservoir 1.

The seat valve 2 is configured as a pilot control valve and it is connected to the reservoir 1 in such a way that, when the seat valve 2 is open, a smaller amount of fluid flows via the seat valve 2, causing a larger amount of fluid to flow out of the reservoir 1 via the non-return valve 3.

The larger amount of fluid is at least one and half times as much as the smaller amount of fluid. The reservoir 1 is thus connected to the seat valve 2 as well as to the non-return valve 3 so to convey fluid. The non-return valve 3 is arranged between a throttle 10 and the reservoir 1.

The non-return valve 3 is connected to or interacts with the throttle 10. The throttle 10 offers resistance to the fluid in one direction of flow of a fluid, and it offers virtually no resistance to the fluid in the opposite direction of flow.

The seat valve 2 switches the throttle 10 from one direction of flow into the other direction of flow. It is, however, likewise conceivable for the throttle 10 to autonomously increase or decrease the resistance to the fluid as a function of the direction of flow of the fluid.

The reservoir 1 can be filled with fluid via the throttle 10. The seat valve 2 can be actuated electromagnetically. The seat valve 2 configured as a pilot control valve is in the form of a 2/2-way seat valve or a 3/2-way seat valve.

Figure 2:
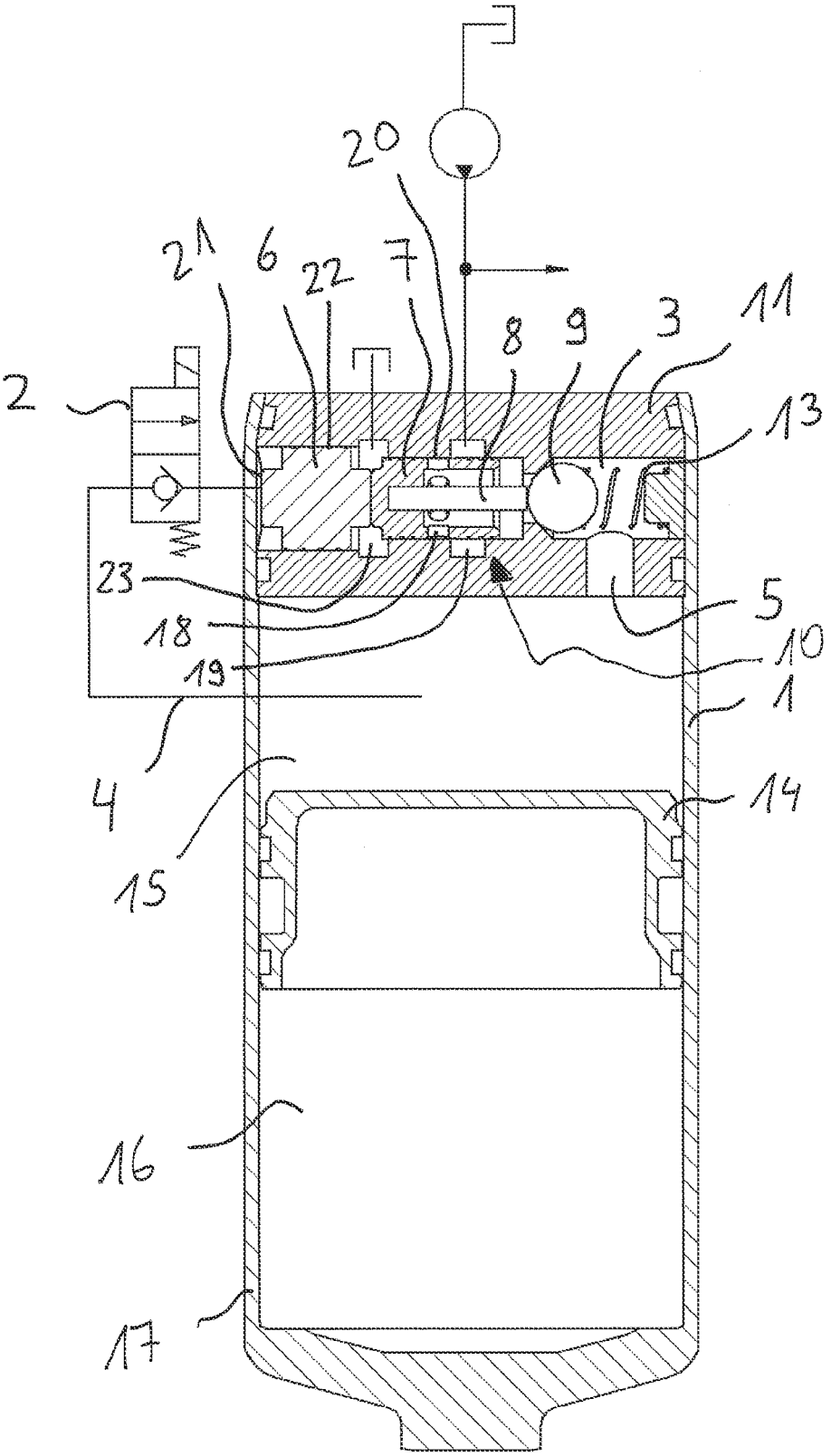

FIG. 2 shows a first embodiment of a valve array that was previously depicted schematically.

A first line 4 leads from the reservoir 1 to the seat valve 2, and a second line 5 leads to the non-return valve 3, whereby the smaller amount of fluid conveyed through the first line 4 exerts pressure on a control piston 6 that opens the non-return valve 3 so that a larger amount of fluid can flow out through the non-return valve 3. The control piston 6 lies against a main piston 7 that has a smaller cross-sectional surface area exposed to pressure.

The main piston 7 holds a needle 8 that lies against a spring-loaded ball 9 of the non-return valve 3.

The non-return valve 3 is integrated into the reservoir 1. The reservoir 1 is configured as a piston reservoir that has a beaded baseplate 11 into which the non-return valve 3 is integrated. The seat valve 2 can likewise be integrated into the baseplate 11.

The reservoir 1 holds a hydraulic oil as the fluid which can be discharged to a consumer via a throttle 10. This emptying of the reservoir 1 to the consumer, however, is done without throttling.

Figure 3:
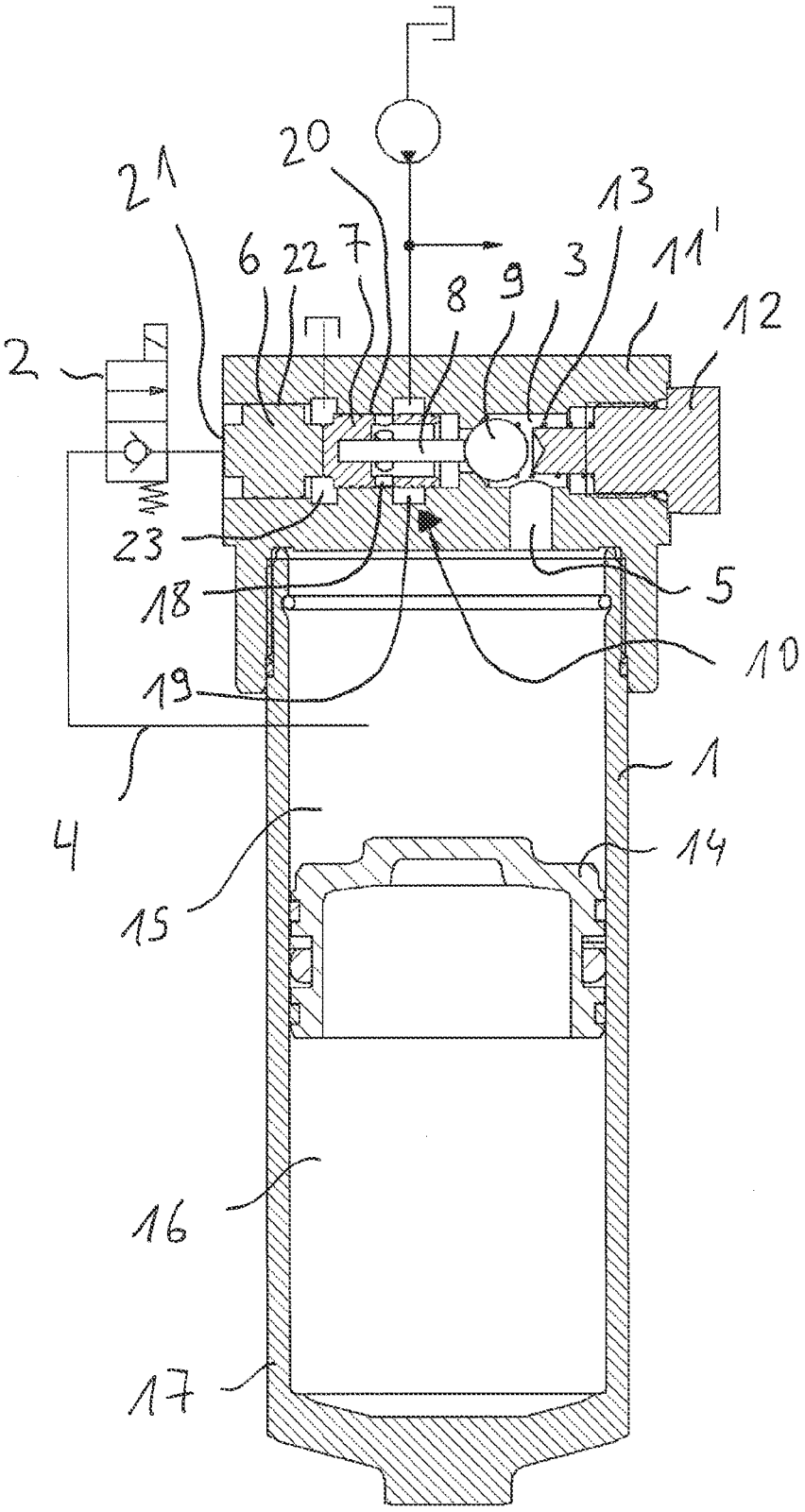

FIG. 3 shows another embodiment of the valve array schematically depicted in FIG. 1.

The non-return valve 3 is integrated into the reservoir 1. The reservoir 1 is configured as a piston reservoir that has a screwed-on baseplate 11' into which the non-return valve 3 is integrated. The baseplate 11' holds a screw 12 by means of which the force exerted by the spring 13 onto the ball 9 can be set. The seat valve 2 can likewise be integrated into the baseplate 11'.

The piston reservoir according to FIGS. 2 and 3 has a piston 14 by means of which a fluid chamber 15 containing a hydraulic oil is separated from a gas chamber 16. The housing 17 of the piston reservoir is configured so as to be open on one side, whereby the open side is closed by means of the baseplate 11, 11'.

The mode of operation of valve arrays described above and having a pilot control function is described below:

A valve array consists of an electromagnetic seat valve 2, a hydraulically unblockable non-return valve 3 and a switchable throttle 10. The unblockable non-return valve 3 is arranged in such a way that it allows a free flow into the reservoir 1. The non-return valve 3 has a blocking action in the discharge direction.

When the reservoir 1 is being filled, an incoming volume flow enters via the throttle 10, bringing about a throttling effect and a controlled filling of the fluid chamber 15. The reservoir 1 is filled via the non-return valve 3.

In order to be able to remove an amount of fluid from the reservoir 1, the electromagnetic seat valve 2 is switched into the flow position. The smaller amount of fluid flowing through the seat valve 2 or the pressure present in the reservoir 1 then acts on an unblocking mechanism of the non-return 3, as a result of which the non-return 3 is unblocked and fluid can flow through it.

At the same time, the actuation of the seat valve 2 causes the throttle 10 to be switched into the direction of a free flow so that the reservoir 1 is emptied in a way that entails as little loss as possible.

FIG. 2 shows a particularly advantageous valve array. The reservoir 1 is configured as a piston reservoir. It goes without saying that any other design of a hydraulic reservoir can be employed. The open side of a cylindrical housing 17 is sealed so as to be pressure-tight by a cylindrical baseplate 11 into which parts of the valve array are integrated.

Parts of the valve array, namely, the non-return valve 3, the control piston 6 and the main piston 7 are preferably arranged at an angle of 90° relative to the longitudinal axis of the cylindrical housing 17. The piston 14 here can be moved along the longitudinal axis. The baseplate 11 is joined to the housing 17 by means of a joining process, preferably a positive-fit beaded connection.

The non-return valve 3 can be implemented very inexpensively in the form of a spring-loaded ball 9, namely, a steel ball bearing held in a conical valve seat. A needle 8 situated in the main piston 7, which is preferably configured as a needle roller, can be used to lift the ball 9 off the valve seat, thus unblocking the non-return valve 3.

Moreover, the function of the switchable throttle 10 is implemented in the main piston 7 in the form of radial holes 18 and an annular groove 19. In the blocked position of the non-return valve 3, as depicted, the radial holes 118 are partially or completely covered by a wall of the slide hole 20. A throttling effect is brought about by a partial covering (not concretely shown in FIG. 2) of the radial holes 18.

When the reservoir 1 is being filled, the throttling effect is set by means of the size of an annular surface. The annular surface is determined by the diameter of the slide hole 20 and by a tapering of the main piston 7 in the area of the radial holes 18.

In a position in which the reservoir 1 is emptied in the direction of a consumer, an axial movement of the main piston 7 opens up a connection that is the size of the cross section and that leads to the annular groove 19, namely a control groove. The connection is determined by the radial holes 18. The annular groove 19 can be connected to a consumer or to a pump. In the above-mentioned position, the fluid can escape to the consumer from the reservoir 1 in the direction of flow.

In order for the reservoir 1 to be emptied, the electromagnetic seat valve 2 is switched into the flow direction. The pressure present in the fluid chamber 15 of the reservoir 1 then acts on the end face 21 of the control piston 6.

The opposite end face as well as the rear side of the main piston 7, which lies against the control piston 6, are connected to an external tank via another annular groove 23. This results in an axial force of the control piston 6 that acts on the main piston 7 and, via the needle 8, onto the ball 9 of the non-return valve 3.

Since the pressure-active surface of the control piston 6 is larger than the sealing surface resulting from the ball 9 and the valve seat, a force is generated that switches the valve array into the flow position.

On the circumferential surface of the control piston 6, there is a spiral groove 22 for establishing a connection between the additional annular groove 23 and a chamber located between the seat valve 2 and the control piston 6.

The electromagnetic seat valve 2 can likewise be arranged in the base plate 11, 11' of the reservoir 1.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

What is claimed is:

1. A valve array comprising:

a reservoir containing a pressurized fluid;

a non-return valve; and a seat valve that is actuatable so as to allow the fluid to flow out of the reservoir, the seat valve being configured as a pilot control valve connected to the reservoir such that, in an open condition of the seat valve, a smaller amount of the fluid flows out of the reservoir via the seat valve and a larger amount of the fluid flows out of the reservoir via the non-return valve.

2. The valve array according to claim 1, wherein the reservoir is connected to the seat valve and the non-return valve so as to convey the fluid.

3. The valve array according to claim 1, further comprising a control piston configured to open the non-return valve upon pressure being exerted on the control piston, a first line extending from the reservoir to the seat valve and a second line extending from the reservoir to the non-return valve, wherein the valve array is configured to convey the smaller amount of fluid through the first so as to exert the pressure on the control piston and convey the larger amount of fluid through the non-return valve.

4. The valve array according to claim 3, wherein the control piston is disposed against a main piston that has a smaller cross-sectional surface area exposed to pressure.

5. The valve array according to claim 4, wherein the main piston holds a needle that is disposed against a spring-loaded ball of the non-return valve.

6. The valve array according to claim 1, further comprising a throttle configured to provide resistance to a flow of fluid in a direction of flow of the fluid and to not provide resistance to the flow of fluid in a direction opposite to the direction of flow of the fluid, wherein the non-return valve is connected to or interacts with the throttle.

7. The valve array according to claim 6, wherein the seat valve is configured to switch the throttle from the direction of flow of the fluid into the direction opposite to the direction of flow of the fluid.

8. The valve array according to claim 6, wherein the throttle is configured to autonomously at least one of increase and decrease the resistance to the fluid based on the direction of flow of the fluid.

9. The valve array according to claim 6, wherein the reservoir is configured to be filled with the fluid via the throttle.

10. The valve array according to claim 1, wherein the non-return valve is integrated into the reservoir.

11. The valve array according to claim 10, wherein the reservoir is configured as a piston reservoir having a baseplate into which the non-return valve is integrated.

12. The valve array according to claim 10, wherein the non-return valve is disposed so as to be actuated at an angle of 90° relative to a longitudinal axis of the reservoir.

13. The valve array according to claim 1, wherein the reservoir includes a baseplate positively joined thereto.

14. The valve array according to claim 1, wherein the seat valve is electromagnetically actuatable.

15. The valve array according to claim 1, wherein the seat valve is configured as the pilot control valve in the form of a 2/2-way seat valve or a 3/2-way seat valve.

* * * * *